US007055204B2

(12) United States Patent
Ajluni

(10) Patent No.: US 7,055,204 B2
(45) Date of Patent: Jun. 6, 2006

(54) CLEANING DEVICE

(75) Inventor: Sherry Ajluni, Cumming, GA (US)

(73) Assignee: The Evercare Company, Alpharetta, GA (US)

( * ) Notice: Subject to any disclaimer, the term of this patent is extended or adjusted under 35 U.S.C. 154(b) by 483 days.

(21) Appl. No.: 10/386,266

(22) Filed: Mar. 11, 2003

(65) Prior Publication Data

US 2004/0177461 A1 Sep. 16, 2004

(51) Int. Cl.
*A47L 13/254* (2006.01)
*A47L 13/12* (2006.01)
*A47L 13/11* (2006.01)
*A47L 1/06* (2006.01)

(52) U.S. Cl. ..... 15/121; 15/232; 15/228; 15/231; 15/144.1; 15/144.2

(58) Field of Classification Search ..... 15/121, 15/144.1, 144.2, 220.1, 228, 231, 232, 245
See application file for complete search history.

(56) References Cited

U.S. PATENT DOCUMENTS

| | | | | |
|---|---|---|---|---|
| 3,099,755 | A | 7/1963 | Bennett, Jr. | |
| 3,760,450 | A | 9/1973 | Griffin et al. | 15/229 |
| 3,792,505 | A | 2/1974 | Saltzstein | 15/231 |
| 3,827,100 | A | 8/1974 | Griffin et al. | 15/229 |
| 3,877,103 | A | 4/1975 | Nash | 15/147 |
| 3,909,870 | A | 10/1975 | Leland | 15/121 |
| 4,106,153 | A | 8/1978 | Lemelson | 15/231 |
| 4,225,998 | A | 10/1980 | Thielen | 15/231 |
| 4,685,167 | A | 8/1987 | Murray | 15/228 |
| 4,712,268 | A | 12/1987 | Heinonen | 15/231 |
| 4,766,632 | A | 8/1988 | Murray | 15/147 |
| 4,823,427 | A | 4/1989 | Gibbs et al. | 15/247 |
| 4,852,210 | A | 8/1989 | Krajicek | 15/228 |
| 4,893,370 | A | 1/1990 | Klotz | 15/121 |
| 4,971,471 | A | 11/1990 | Sloan | 401/203 |
| 4,991,250 | A | 2/1991 | Young | 15/228 |
| 5,205,012 | A | 4/1993 | Coley | 15/210.1 |
| 5,410,772 | A | 5/1995 | Lewis | 15/228 |
| 5,461,749 | A | 10/1995 | Ahlberg et al. | 15/228 |
| 5,477,582 | A | 12/1995 | Yamashita | 15/231 |
| 5,553,344 | A | 9/1996 | Rosenkrantz | 15/104.002 |
| 5,655,250 | A | 8/1997 | Warrell | 15/228 |
| 5,815,878 | A | 10/1998 | Murakami et al. | 15/231 |

(Continued)

FOREIGN PATENT DOCUMENTS

| | | |
|---|---|---|
| CH | 280117 | 4/1952 |

(Continued)

OTHER PUBLICATIONS

Printout from organizedhome.com website entitled "Update: Electrostatic Dry Sweepers". (undated).

(Continued)

*Primary Examiner*—Mark Spisich
*Assistant Examiner*—Shay L. Balsis
(74) *Attorney, Agent, or Firm*—Gifford, Krass, Groh, Sprinkle, Anderson & Citkowski, P.C.

(57) ABSTRACT

A cleaning device having a support pad with a planar side and a side opposed to the planar side. An electrostatic cleaning sheet is detachably secured across the planar side of the pad. An elongated arm is secured at one end to the opposed side of the support pad. An elongated handle has one end secured to the other end of the arm by a locking joint which selectively locks the handle to the arm at a plurality of predetermined angular positions. A rubber blade which forms a squeegee is also secured to the opposed side of the support pad.

13 Claims, 5 Drawing Sheets

U.S. PATENT DOCUMENTS

| | | | | |
|---|---|---|---|---|
| 5,845,361 | A | 12/1998 | Murakami et al. | 15/231 |
| 5,862,562 | A | 1/1999 | Erken | 15/117 |
| 5,888,006 | A | 3/1999 | Ping et al. | 401/137 |
| D409,343 | S | 5/1999 | Kingry et al. | D32/50 |
| 6,016,586 | A * | 1/2000 | Hsu | 15/144.1 |
| 6,032,317 | A | 3/2000 | Wiley | 15/220.1 |
| 6,032,321 | A * | 3/2000 | Shirey et al. | 15/244.2 |
| D423,742 | S | 4/2000 | Kingry et al. | D32/40 |
| 6,061,864 | A | 5/2000 | Ensson | 15/147.1 |
| 6,098,239 | A | 8/2000 | Vosbikian | 15/228 |
| 6,119,298 | A | 9/2000 | Kenmochi | 15/231 |
| D438,354 | S | 2/2001 | Cann | D32/35 |
| 6,202,250 | B1 | 3/2001 | Kenmochi et al. | 15/231 |
| 6,243,909 | B1 | 6/2001 | Graham et al. | 15/228 |
| 6,305,046 | B1 | 10/2001 | Kingry et al. | 15/231 |
| 6,332,234 | B1 | 12/2001 | Graham et al. | 15/228 |
| D458,457 | S | 6/2002 | Sugano et al. | D4/132 |
| D458,722 | S | 6/2002 | Romero et al. | D32/52 |
| 6,588,045 | B1 * | 7/2003 | Fernandez | 15/119.2 |
| 2001/0046407 | A1 | 11/2001 | Kunkler et al. | 401/140 |
| 2001/0047559 | A1 | 12/2001 | Graham et al. | 15/228 |
| 2002/0026680 | A1 | 3/2002 | Kingry et al. | 15/228 |
| 2002/0042962 | A1 | 4/2002 | Willman et al. | 15/208 |
| 2002/0050016 | A1 | 5/2002 | Willman et al. | 15/104.002 |
| 2002/0078518 | A1 * | 6/2002 | Jiang | 15/111 |
| 2002/0078519 | A1 * | 6/2002 | Boothby | 15/121 |
| 2002/0138934 | A1 | 10/2002 | Petner et al. | 15/229.6 |

FOREIGN PATENT DOCUMENTS

| | | |
|---|---|---|
| DE | 200 03 773 | 6/2000 |
| WO | WO 02/41743 | 11/2001 |
| WO | WO 02/41746 | 11/2001 |
| WO | WO 02/41747 | 11/2001 |

OTHER PUBLICATIONS

Printout from homemadesimple.com website entitled "Learn more about Swiffer." 2002.

Printout from designawards.com.au website regarding "Wagtail Combi".

* cited by examiner

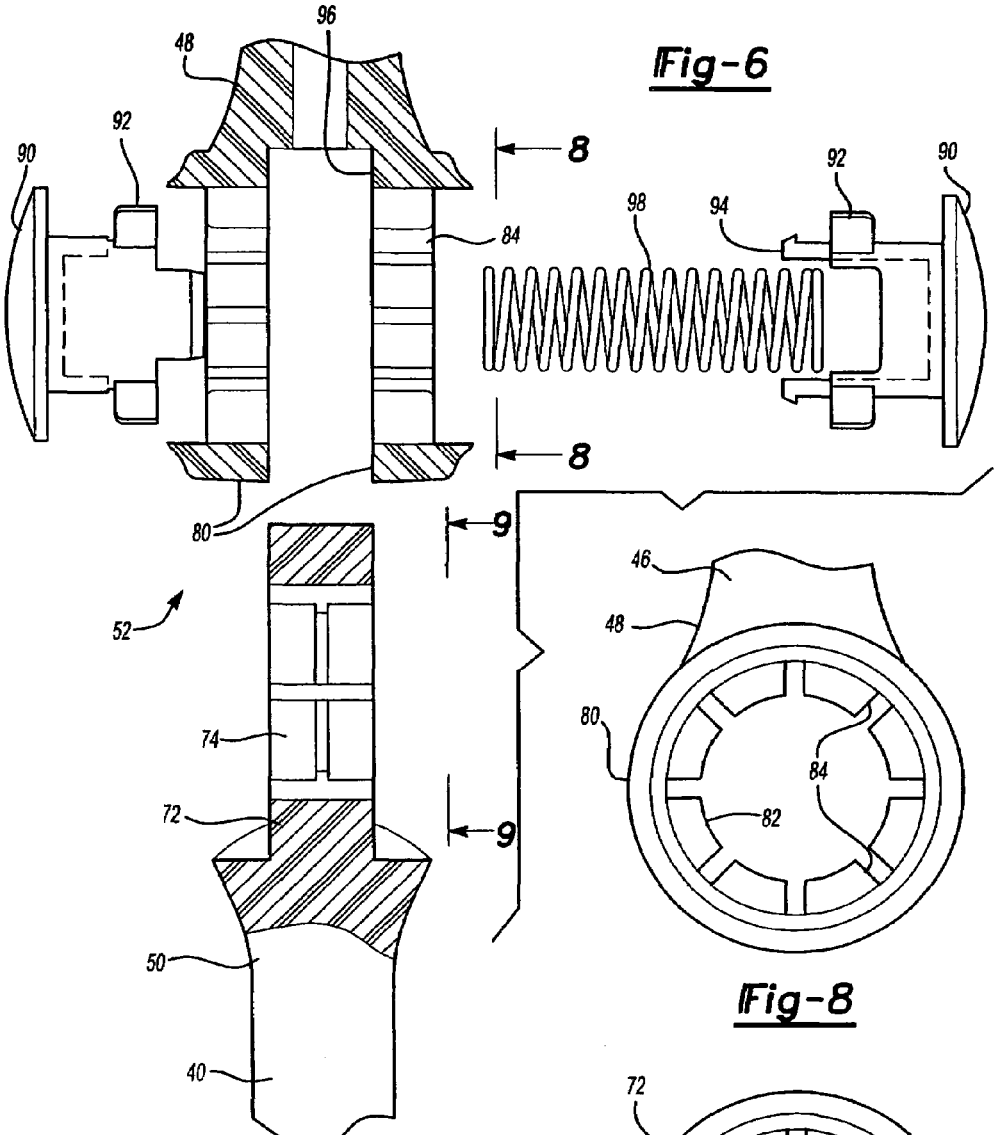
Fig-6
Fig-8
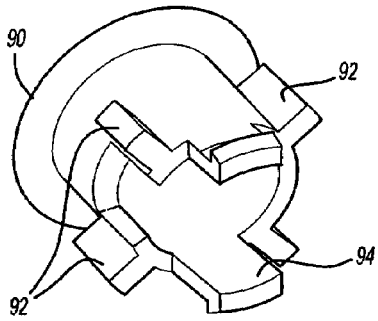
Fig-7
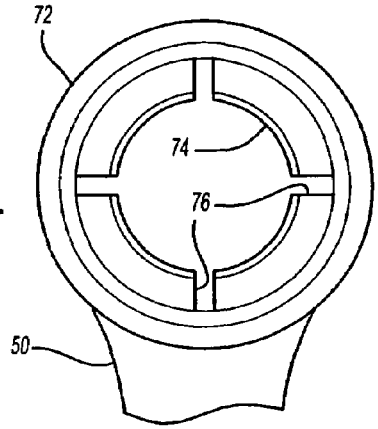
Fig-9

CLEANING DEVICE

BACKGROUND OF THE INVENTION

I. Field of the Invention

The present invention relates generally to a cleaning device and, more particularly, to a combination cleaning pad and squeegee.

II. Description of the Prior Art

There are many previously known cleaning devices which typically comprise a cleaning pad having a planar surface. An elongated handle is secured to the opposite side of the support pad while an electrostatic cleaning sheet is detachably secured across the planar side of the pad. In use, the cleaning pad is manipulated by the handle along the surface to be cleaned such that the electrostatic sheet removes dirt from that surface.

While cleaning pads with electrostatic sheets are highly effective for cleaning certain surfaces, they are ineffective for cleaning windows and similar surfaces. Consequently, in addition to electrostatic cleaning pads, it has been previously necessary to utilize a separate cleaning tool, namely a squeegee, for cleaning windows and like surfaces. The requirement to have both a squeegee as well as electrostatic cleaning pad increases not only the cost of the cleaning tools but also their required storage space.

SUMMARY OF THE PRESENT INVENTION

The present invention provides a combination electrostatic cleaning pad and squeegee which overcomes all of the above-mentioned disadvantages of the previously known devices.

In brief, the cleaning device of the present invention comprises a support pad having a planar side and a side opposed to the planar side. An electrostatic cleaning sheet is detachably secured to the support pad so that the electrostatic cleaning sheet extends over and covers the planar side of the support pad.

An elongated arm is secured at one end to the opposed side of the support pad. An elongated handle then has one end secured to the second end of the arm by a locking joint. Preferably, the locking joint between the arm and the handle enables the arm and the handle to be locked together at any of a plurality of predetermined pivotal positions.

An elongated rubber blade is secured to the opposed side of the support pad. In use, this elongated rubber blade functions as a squeegee for cleaning windows when desired.

Consequently, unlike the previously known devices, the cleaning device of the present invention functions not only as a cleaning pad for cleaning certain surfaces, but also as a squeegee for cleaning windows and like surfaces.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which:

FIG. 6 is a fragmentary partial sectional exploded view illustrating the preferred embodiment of the locking joint for the present invention;

FIG. 7 is an elevational view illustrating one component of the locking joint;

FIG. 8 is a view taken substantially along line 8—8 in FIG. 6;

FIG. 9 is a view taken substantially along line 9—9 in FIG. 6;

DETAILED DESCRIPTION OF A PREFERRED EMBODIMENT OF THE PRESENT INVENTION

Figure 1:
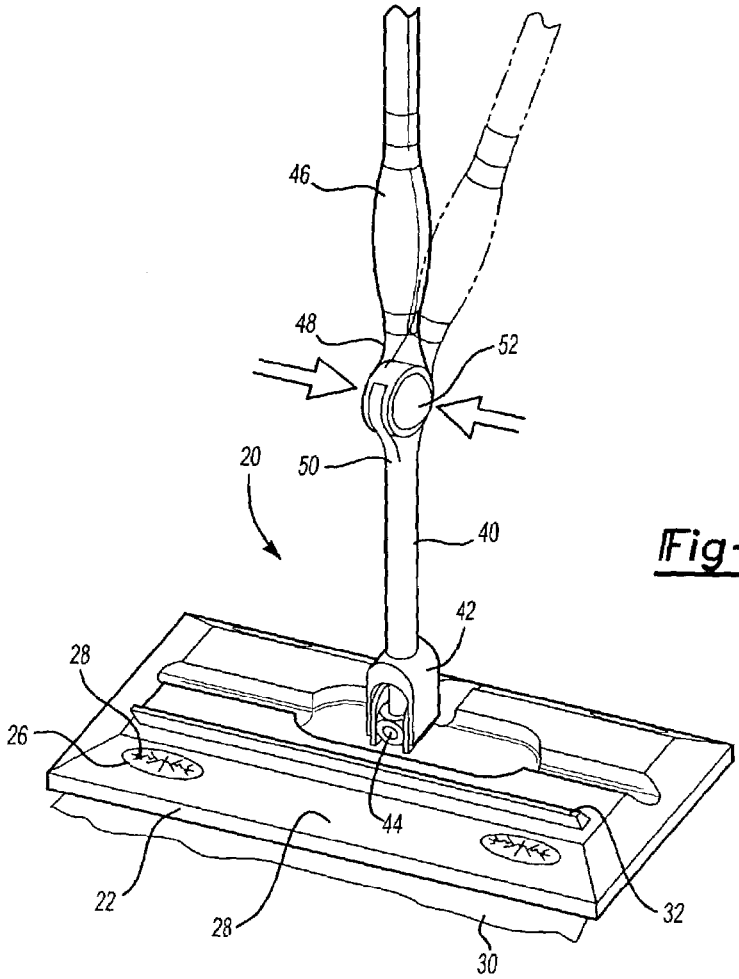
FIG. 1 is a perspective view illustrating a preferred embodiment of the invention.
Figure 2:
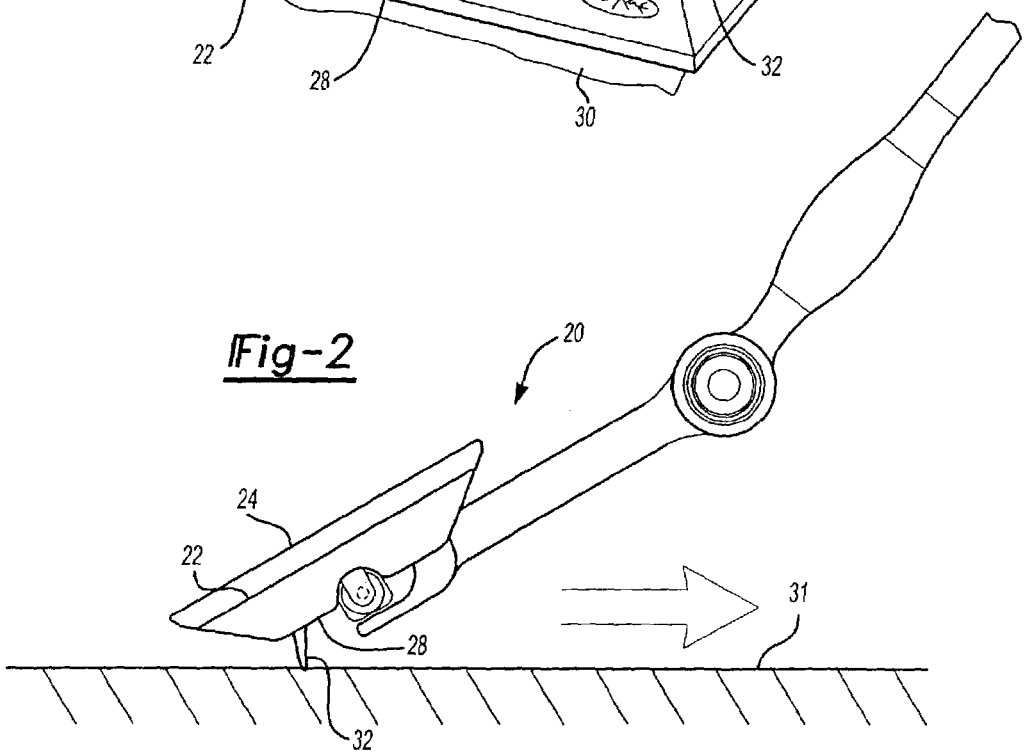
FIG. 2 is a side view illustrating the preferred embodiment of the invention.

With reference first to FIGS. 1 and 2, a preferred embodiment of the cleaning device 20 of the present invention is shown. The cleaning device 20 includes a generally rectangular support pad 22 having a planar surface 24 on one side. The support pad 22 is preferably made of plastic.

Figure 5:
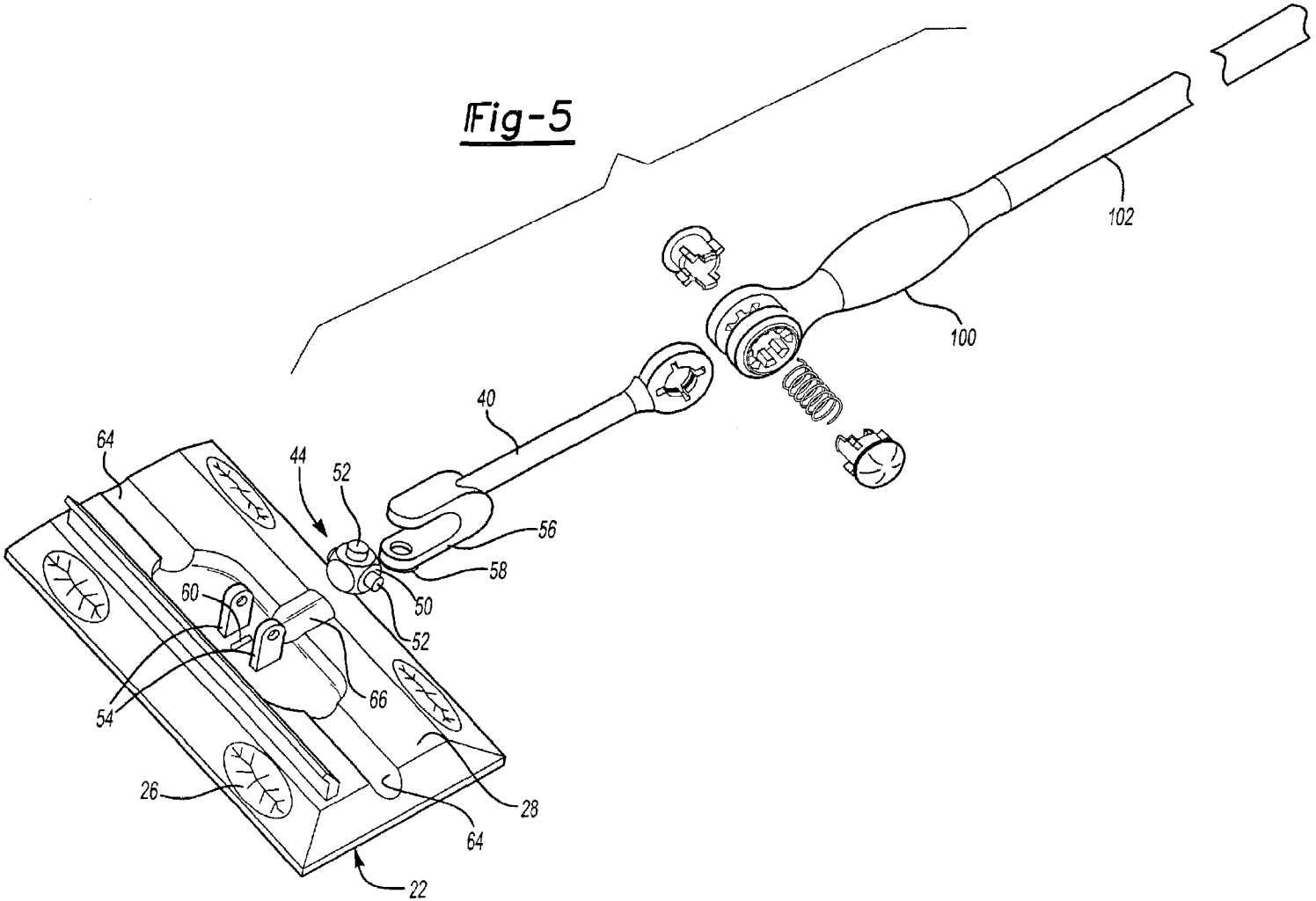
FIG. 5 is an elevational exploded view of the preferred embodiment of the invention.

With reference now particularly to FIGS. 1 and 5, a resilient insert 26 is mounted to each corner of the support pad 22 on its side 28 opposite from its planar surface 24. These resilient inserts 26 each include an erose cut 28 formed through the insert 26. An electrostatic cleaning sheet 30 (FIG. 1) is then detachably secured to the support pad 22 across the planar surface 24 by pushing the four corners of the electrostatic sheet 30 through the erose cut 28 on the four inserts 26. Upon release, the inserts 26 frictionally engage the sheet 30. The inserts 26 thus detachably secure the electrostatic cleaning sheet 30 to the support pad 22 for use in a cleaning operation. However, as the electrostatic pad 30 becomes soiled, it can be easily removed from the support pad 22 and replaced with a clean electrostatic sheet 30.

The inserts 26 are preferably positioned adjacent the four corners of the pad 22 and are aligned at an angle with respect to the plane of the pad 22. As such, the inserts 26 minimize wastage of the electrostatic cleaning sheets 30.

With reference again to FIGS. 1 and 2, an elongated resilient blade 32 is secured to the side 28 of the support pad 22. The blade 32 is constructed from any conventional material, such as plastic or synthetic rubber. This blade 32 thus enables the cleaning device 20 to function as a squeegee as best shown in FIG. 2 for cleaning glass 31 and similar surfaces.

Figure 3:
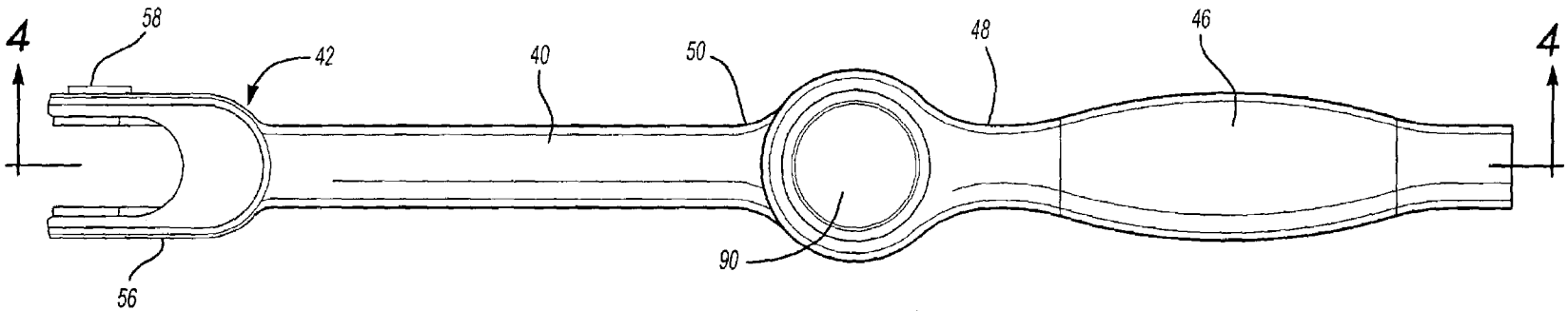
FIG. 3 is a plan view illustrating the handle and arm of the preferred embodiment of the present invention.
Figure 4:
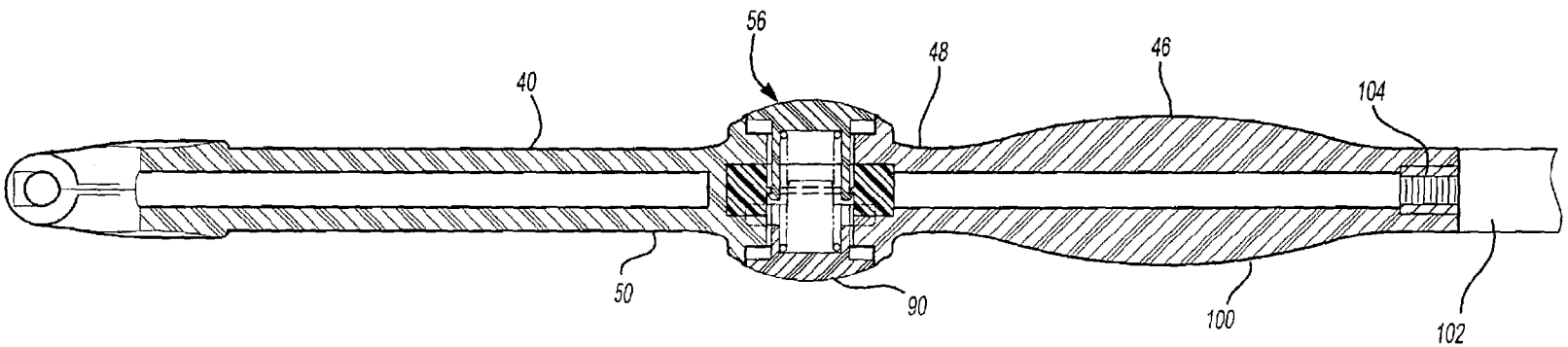
FIG. 4 is a longitudinal sectional view taken substantially along line 4—4 in FIG. 3.

With reference now to FIGS. 1, 3 and 4, an elongated arm 40 has a first end 42 secured by a pivot joint 44 to the side 28 of the support pad 22. An elongated handle 46 has a first end 48 secured to a second end 50 of the arm 40 by a lock joint 52 which will be subsequently described in greater detail. The handle 46 and arm 40 thus facilitate movement of the support pad 22 across the surface to be cleaned, either by the electrostatic sheet 30 secured to its planar side 34, or by the resilient blade 32.

With reference to FIGS. 4 and 5, the arm 46 preferably includes a first part 100 and second part 102. The handle parts 100 and 102 are detachably secured together by a threaded connector 104 so that the cleaning device 20 can be used as a small, hand held device with the handle part 102 removed, or as a long handle device with the handle parts 100 and 102 secured together.

With reference now to FIG. 5, the pivot joint 44 is there shown in greater detail and comprises a pivot ball 50 having outwardly extending pivot pins 52 along two axes that are perpendicular to each other. A first set of aligned pivot pins 52 on the ball 50 are mounted within receiving holes in a pair of spaced pivot supports 54 secured to and extending outwardly from the side 28 of the support pad 22. Similarly, the other pivot pins 52 are mounted within receiving holes in a U-shaped yoke 56 formed at the first end 42 of the arm 40. Consequently, the pivot ball 50 enables the arm 40 to pivot about two axes perpendicular to each other.

Referring now to FIGS. 3 and 5, in the preferred embodiment, an outwardly extending flange 58 is formed on the yoke 56. This flange 58 is resiliently received within a recess 60 (FIG. 5) formed in the support pad 22 to resiliently, but releasably, lock the arm 40 to the support pad 22 when the arm 40 is in the position illustrated in FIG. 2. Furthermore, appropriate recesses 64 and 66 are formed in the support pad 22 so that the arm 40 may nest within these recesses 64 or 66, when desired.

With reference now to FIGS. 6–9, the lock joint 52 is there shown in greater detail. An annular hub 72 is formed at the second end 50 of the arm 40. This annular hub 72 includes a generally circular throughbore 74. Additionally, as best shown in FIGS. 6 and 9, a plurality of circumferentially spaced and radially extending slots 76 are formed through the arm hub 72 so that each slot 76 is open to the throughbore 74 and extends axially along the arm hub 72.

As best shown in FIGS. 6 and 8, a pair of spaced and aligned hubs 80 are also formed at the first end 48 of the handle 46. Each hub 80 includes a throughbore 82. Furthermore, as best shown in FIG. 8, a plurality of circumferentially spaced and radially extending slots 84 are formed through the handle hub 80 so that each slot 82 is open to the throughbore 82 and extends axially along the handle hub 80.

As best shown in FIGS. 4 and 6, the hubs 72 and 80 are dimensioned so that the arm hub 72 is positioned in between the handle hubs 80 as shown in FIG. 4. In doing so, the arm hub 72 is sandwiched in between the handle hubs 80 so that the throughbores 74 and 82 of the arm hub 72 and handle hub 80, respectively, register with each other.

With reference now particularly to FIGS. 4, 6 and 7, at least one and preferably two buttons 90 are disposed in an opposed relationship within the handle hubs 80 when the handle hubs 80 and arm hub 72 are in their assembled position (FIG. 4). Each button 90, furthermore, includes at least one and preferably a plurality of radially outwardly extending and circumferentially spaced locking tabs 92. These locking tabs 92 are slidably received within the arm hub slots 76 and handle hub slots 84 when the slots 76 and 84 are aligned with each other.

In order to secure the buttons 90 to the handle hub 80, each button 90 preferably includes at least one and preferably two snap tabs 94. These snap tabs 94 have an outer diameter slightly greater than the diameter of the handle hub throughbore 82. Upon insertion of the buttons 90 into the handle hubs 80, the locking tabs 94 deflect radially inwardly. Upon full insertion, the locking tabs 94 flex radially outwardly and engage an annular abutment surface 96 (FIG. 6) thus locking the buttons 90 against retraction to the hubs 80.

Figure 10:
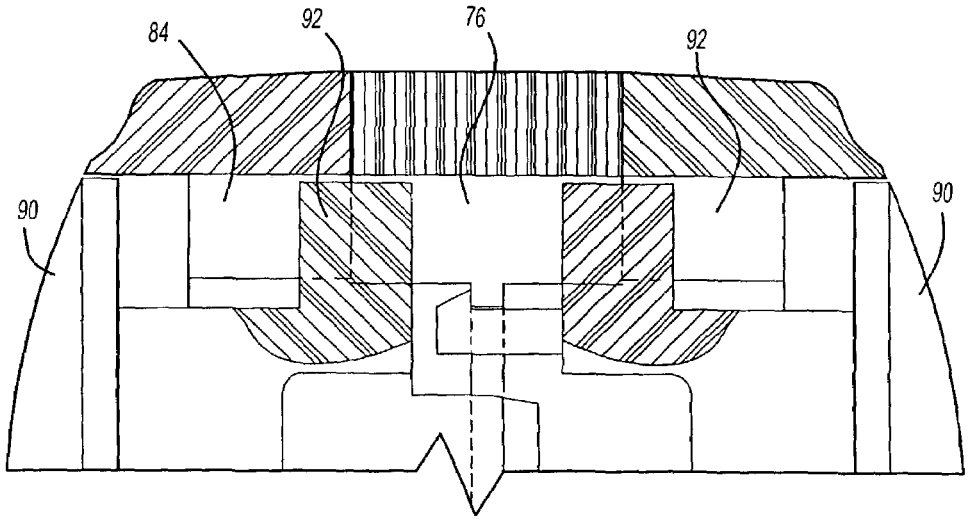
FIG. 10 is a cross-sectional view illustrating a portion of the locking joint of the present invention illustrating the locking joint in a locked position.
Figure 11:
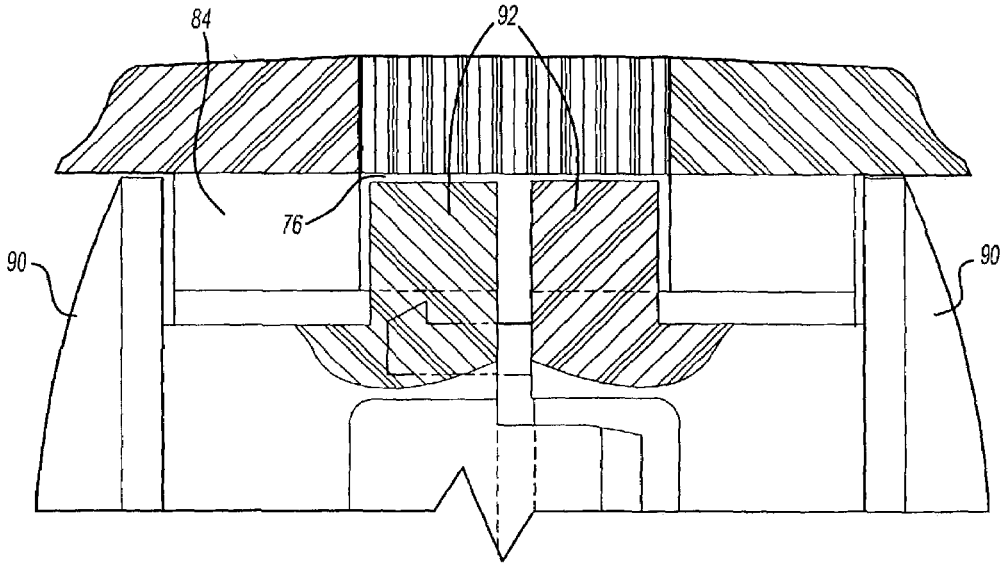
FIG. 11 is a view similar to FIG. 10 but illustrating the locking joint in an unlocked position.

With reference now to FIGS. 6, 10 and 11, the buttons 90 are movable between an extended position, illustrated in FIG. 10, and a depressed position, illustrated in FIG. 11. When in their extended position (FIG. 10), the button locking tabs 92 are partially positioned within both the arm hub slot 76 and handle hub slots 84. Thus, when in their extended position, the locking tabs 92 prevent pivoting of the arm 40 relative to the handle 48.

Conversely, when the buttons 90 are moved to their depressed position, illustrated in FIG. 11, the locking tabs 92 are positioned wholly within the arm slots 76. When in their depressed position, the locking tabs 92 permit the handle 48 to be pivoted relative to the arm 40 until the arm hub slots 76 register with a different set of handle hub slots 84. A compression spring 98 (FIG. 6) urges the buttons to their extended position (FIG. 10) so that when the locking tabs 92 are aligned with a different set of handle hub slots 84, the spring 98 returns the buttons 90 to their extended position thus locking the handle 46 and arm 40 together at a different pivotal position.

Since the lock joint 52 positively locks the support pad 22 with its attached electrostatic sheet 30 at multiple user selected angles, difficult surfaces, such as the tops of ceiling fan blades, can be easily cleaned.

From the foregoing, it can be seen that the cleaning device of the present invention provides a simple and yet highly effective cleaning device for use with both an electrostatic pad as well as for use as a squeegee. Having described my invention, however, many modifications thereto will become apparent to those skilled in the art to which it pertains without deviation from the spirit of the invention as defined by the scope of the appended claims.

I claim:

1. A cleaning device comprising:

a support pad having a planar side and a side opposed to said planar side, said support pad having means for detachably securing a cleaning sheet across said planar side, an elongated arm pivotally secured about two axes at one end to said opposed side of said support pad, an elongated handle, one end of said handle being secured to one end of said arm, a squeegee secured to said opposed side of said support pad means for selectively locking said one end of said arm to said support pad at at least two predetermined pivotal positions, and wherein said selective locking means comprises an outwardly extending flange on said arm, said flange being resiliently received in a recess on said support pad when said arm is in either of said predetermined pivotal positions to thereby lock said arm to said support pad against movement relative to one of said axes, and wherein said selective locking means further comprises at least two additional recesses in said support pad, one recess receiving a portion of said arm when said arm is in one of said predetermined positions and the other recess receiving said portion of said arm when said arm is in the other of said predetermined positions to thereby lock said arm to said support pad against movement relative to the other of said axes.

2. The invention as defined in claim 1 and comprising means for securing and locking one end of said handle to a second end of said arm at any of a plurality of predetermined pivotal positions of said handle relative to said arm.

3. The invention as defined in claim 2 wherein said locking and securing means comprises:

an annular arm hub having a throughbore and attached to said second end of said arm, a pair of annular handle hubs at least one of which has a throughbore and attached to said one end of said handle, said handle hubs being disposed on opposite sides of said arm hub so that said at least one handle hub throughbore and said arm hub throughbore register with each other, said arm hub having at least one slot open to said arm hub throughbore, at least one of said handle hubs having a plurality of circumferentially spaced slots open to said handle hub throughbore, at least one button mounted to one of said handle hubs and movable between an extended position and a retracted position, each slot having at least one locking tab slidably mounted in said arm hub slot and said handle hub slot, wherein with said button in said retracted position, said locking tab is wholly positioned in said arm hub slot thereby enabling said arm and said handle to pivot relative to each other, with said button in said extended position, a portion of said locking tab is positioned in both said arm hub slot and said handle slot thereby pivotally locking said arm and said handle together.

4. The invention as defined in claim 3 and comprising a spring for urging said button towards said retracted position.

5. The invention as defined in claim 3 wherein said at least one locking tab comprises a plurality of circumferentially spaced locking tabs, said at least one arm hub slot comprises a plurality of circumferentially spaced slots, each tab being aligned with one slot in said arm hub.

6. The invention as defined in claim 3 and comprising a second button substantially identical to said first mentioned button, said second button being movably mounted to the other handle hub.

7. The invention as defined in claim 6 and comprising a compression spring disposed between said buttons.

8. The invention as defined in claim 3 wherein said arm and said arm hub is of a one-piece plastic construction.

9. The invention as defined in claim 3 wherein said handle and said handle hubs are of a one-piece plastic construction.

10. The invention as defined in claim 3 wherein said at least one button comprises an outwardly extending snap tab, said snap tab engaging an abutment surface on said handle hub to secure said button to said handle hub.

11. The invention as defined in claim 1 and comprising means for pivotally securing said one end of said arm to said opposed side of said support pad.

12. The invention as defined in claim 11 wherein said pivotal securing means further comprises means for pivotally securing said one end of said arm to said opposed side of said support pad about two perpendicular axes.

13. The invention as defined in claim 1 wherein said detachable securing means comprises a plurality of inserts secured to said opposed side of said support pad, said inserts being constructed of a resilient material and having an erose cut extending therethrough.

* * * * *